US005672237A

United States Patent [19]

Whiteford et al.

[11] Patent Number: 5,672,237

[45] Date of Patent: Sep. 30, 1997

[54] POSTAGE STAMP APPLICATOR

[76] Inventors: Bruce W. Whiteford, 8024 Northern Dr., Minneapolis, Minn. 55427; Larry R. Whiteford, 1015 16th Ave. SE., Minneapolis, Minn. 55414

[21] Appl. No.: 447,618

[22] Filed: May 23, 1995

[51] Int. Cl.[6] ..... B65C 9/00; B43M 3/00

[52] U.S. Cl. ..... 156/566; 156/442; 156/521; 156/528

[58] Field of Search ..... 156/442, 442.3, 156/521, 522, 566, 571, 578, 580, DIG. 2, DIG. 24, DIG. 33, DIG. 35, DIG. 39, DIG. 40

[56] References Cited

U.S. PATENT DOCUMENTS

| | | | |
|---|---|---|---|
| 3,186,890 | 6/1965 | Dorn et al. | 156/363 |
| 3,364,095 | 1/1968 | Govatsos | 156/442 |
| 3,802,941 | 4/1974 | Whiteford et al. | 156/442 |
| 3,945,878 | 3/1976 | Hubschmitt | 156/539 |
| 4,832,783 | 5/1989 | Nechay et al. | 156/448 |
| 4,865,678 | 9/1989 | Peyre | 156/356 |

*Primary Examiner*—Christopher Kim
*Attorney, Agent, or Firm*—James W. Miller

[57] ABSTRACT

A postage stamp applicator includes a stamp applicator drum rotatably carried on a housing for oscillating motion. A free end of a coiled supply of stamps extends to the stamp applicator drum. A metering head on the stamp applicator drum advances and severs a predetermined number of stamps as the stamp applicator drum oscillates through one complete cycle of oscillation corresponding to the movement of each envelope that passes beneath the applicator. The outer surface of the stamp applicator drum includes a plurality of decurling rollers that press down on the front side of the predetermined number of stamps to help affix such stamps to the face of the envelope. The stamp applicator drum is oscillated by a crank arm and crankshaft combination that connects the drive shaft on which the stamp applicator drum is mounted to a rotary driven input that rotates one full turn for each envelope passing beneath the applicator. A swing arm pivotally mounts a guide roller adjacent the coiled stamp supply such that the free end of the stamps passes over the pivot point for the swing arm and then down and back around the guide roller in a S-shaped manner as the free end of the stamps extends towards the stamp applicator drum.

18 Claims, 5 Drawing Sheets

POSTAGE STAMP APPLICATOR

TECHNICAL FIELD

This invention relates to an applicator for affixing postage stamps or the like to envelopes passing through automated mailing machines, such as postage metering machines.

BACKGROUND OF THE INVENTION

Postage metering machines are very well known and have been in use for many years. Such machines include a housing having a mail guide channel for allowing envelopes to be fed into and through the machine. Each envelope passes between a rotatable print wheel and a printing platen in the guide channel, the print wheel being driven by the motor of the postage metering machine. The print wheel has means for printing postage onto the face of each envelope as it passes between the print wheel and the printing platen. Postage metering machines of this type are used to quickly print postage onto many envelopes which are quickly fed one by one through the mail guide channel to be each imprinted by the print wheel.

It is sometimes desirable to apply traditional adhesive backed postage stamps to the envelopes rather than using printed postage. The use of postage stamps rather than printed postage is often though to be more personalized. In addition, postage stamps are more colorful and often have particular themes that can be effectively used on particular envelopes. However, it is difficult, if not impossible, to manually sever, lick and apply such postage stamps to large numbers of envelopes.

Various applicators have been used in the past for applying traditional postage stamps in an automated fashion to envelopes. One such applicator is shown in U.S. Pat. No. 3,802,941 to Whiteford et al. In the Whiteford applicator, a rotary, stamp affixing drum receives the free end of a ribbon of stamps from a coiled supply of such stamps through a hollow shaft on which the drum is mounted, the stamp ribbon twisting as it passes through the hollow shaft onto a metering head carried on the drum. As the drum rotates in a complete 360° cycle of rotation, the drum feeds or meters a predetermined number of stamps out of the drum, moistens such stamps, severs the stamps, and then applies the stamps to the envelope passing beneath the drum.

While the Whiteford applicator shown in the above-identified patent was effective, it had a number of disadvantages. For example, the stamp ribbon necessarily twisted as it passed through the hollow shaft to the metering head carried on the drum making it more difficult to feed the stamps smoothly without problems. In addition, the stamp coil had to be carried on the same rotary shaft on which the drum was mounted. Thus, the mounting for the stamp coil was complex, i.e. in a slot or relieved area of the shaft, and the size of the stamp coil that could be carried on the shaft was limited. This smaller size stamp coil required that the operator install new stamp coils more frequently than is desirable.

Other known postage stamp applicators have a rotary vacuum drum. In such applicators, the stamps are carried in coils that are separate from the drum and need not rotate with the drum. A pump creates a vacuum which is applied to the surface of the drum to temporarily adhere a stamp to the drum with the drum then rotating to subsequently affix the stamp to the envelope when the vacuum is discontinued. A major disadvantage of such vacuum applicators is the expense of the pump required to create the vacuum and the controls needed to properly apply and discontinue the vacuum from the drum. In addition, these applicators are extremely noisy due to the operation of the vacuum pump and thus uncomfortable for the operator.

Another problem with prior art stamp applicators, whether of the vacuum or mechanical drum type, is the fact that stamps carried in coils have a curl shape as they come off the coil. This curl can be so pronounced that the stamp is difficult to affix to the envelope, namely it does not lie flat while the drum attempts to affix it to the envelope. Thus, many of the prior art applicators would not reliably affix stamps when the curl in the stamps was severe or pronounced.

SUMMARY OF THIS INVENTION

One aspect of this invention is to provide a postage stamp applicator for an automated mailing machine which reliably applies at least one postage stamp to each envelope passing through the machine.

These and other aspects of the invention are provided in an postage stamp applicator including a housing. A stamp applicator drum is rotatably mounted on the housing. Metering means on the stamp applicator drum is operative upon rotation of the stamp applicator drum to meter a predetermined number of stamps from the stamp applicator drum. A drive means is provided for oscillating the stamp applicator drum back and forth on the housing in forward and reverse directions during operation of the metering means.

Another aspect of this invention relates to a postage stamp applicator including a housing. A stamp applicator drum is rotatably mounted on the housing. Metering means on the stamp applicator drum is operative upon rotation of the stamp applicator drum to meter a predetermined number of stamps from the stamp applicator drum. The stamp applicator drum has an outer surface. A means is carried on the stamp applicator drum and projecting radially outwardly beyond the outer surface of the stamp applicator drum for engaging a front side of the predetermined number of postage stamps to press the predetermined number of postage stamps towards an outwardly directed surface of an envelope for affixation to the envelope.

Yet another aspect of this invention relates to a postage stamp applicator including a housing. A stamp applicator drum is rotatably mounted on the housing. Metering means on the stamp applicator drum is operative upon rotation of the stamp applicator drum to meter a predetermined number of stamps from the stamp applicator drum. A coiled supply of stamps is carried on the housing having a free end for extending to the stamp applicator drum. A swingable guide roller is carried on the housing and pivoted thereon at an upper pivot point. The free end of the stamps extends from the coiled supply to the metering means after passing over the pivot point and then down and around the roller in an S-shaped manner to allow the swingable roller to help direct the free end of the stamps from the coiled supply thereof to the metering means.

BRIEF DESCRIPTION OF THE DRAWINGS

This invention will be described more completely in the following Detailed Description, when taken in conjunction with the following drawings, in which like referenced numerals refer to like elements throughout.

DETAILED DESCRIPTION

Figure 1:
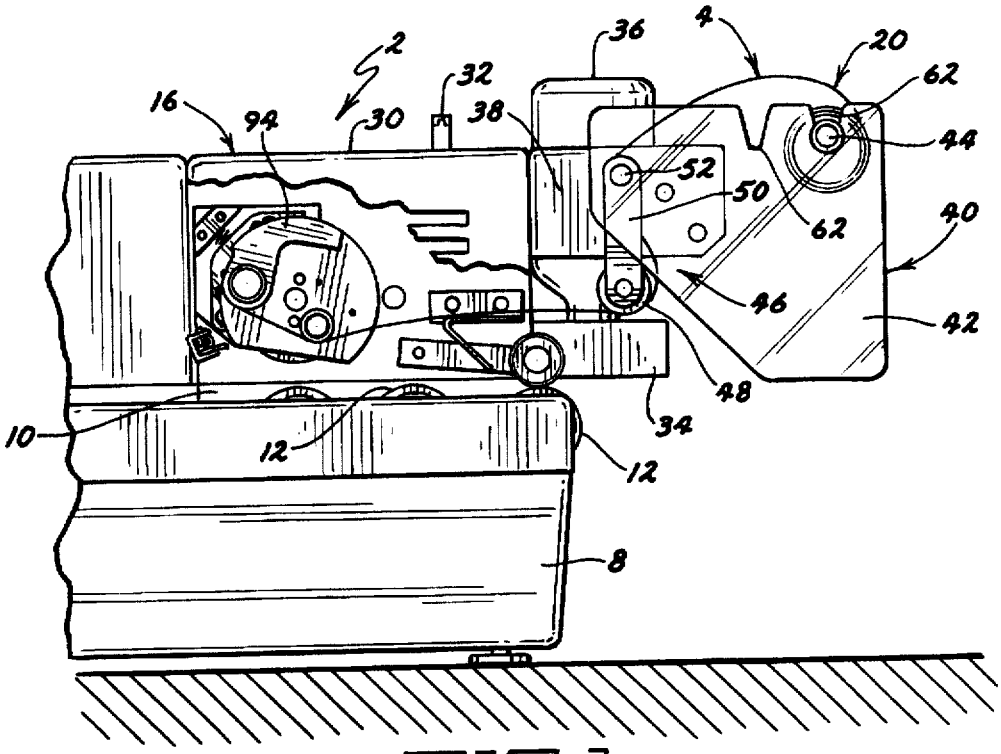
FIG. 1 is a side elevational view of a generally conventional postage metering machine having the stamp applicator of this invention installed thereon, a portion of the stamp applicator being partially broken away to illustrate the front of the stamp applicator drum.

This invention relates to a postage stamp applicator 2 for automatically affixing postage stamps 4 or the like to envelopes being fed through an automated mailing machine, such as a postage metering machine 8. FIG. 1 illustrates applicator 2 affixed to a conventional postage metering machine 8 in place of the usual postage metering head that normally prints the postage onto the envelopes. Thus, applicator 2 can be made as an attachment for a pre-existing postage metering machine 8 to be used in place of the conventional postage metering head. However, applicator 2 can also be made as part of an original equipment mailing machine having means for feeding envelopes sequentially therethrough without departing from the scope of this invention.

Figure 4:
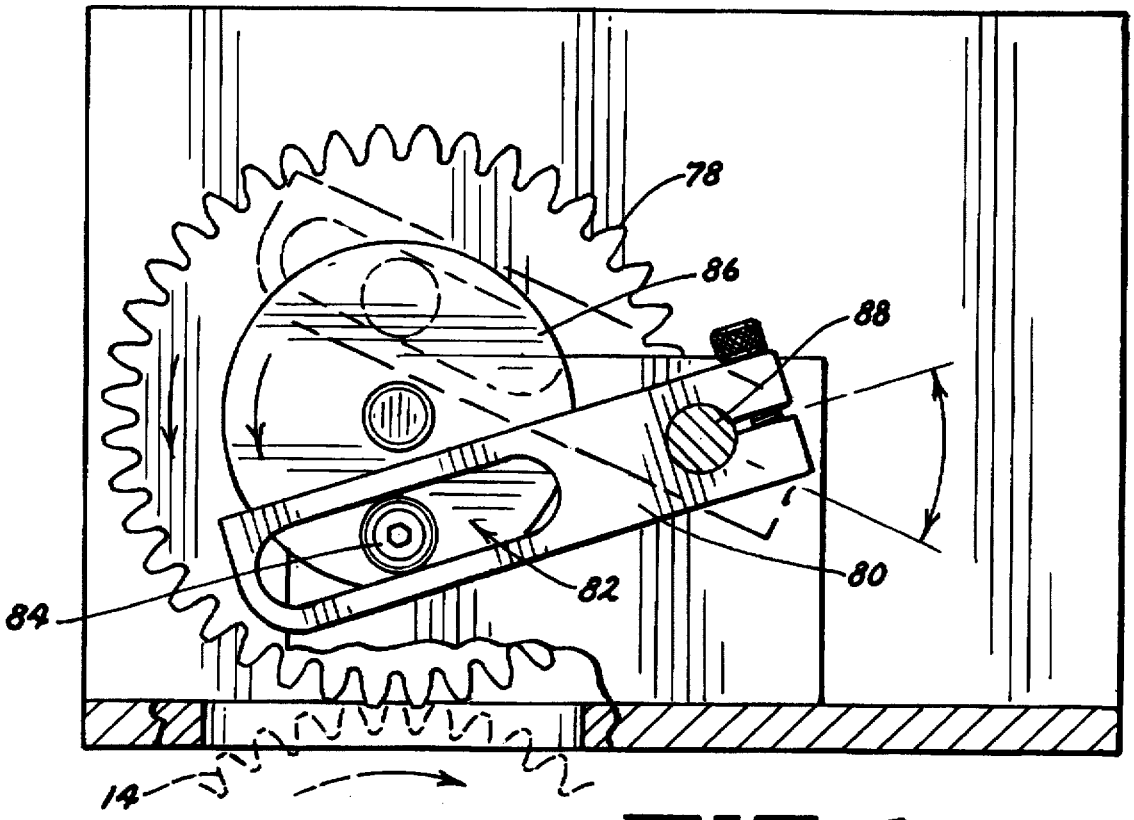
FIG. 4 is a cross-sectional view taken along lines 4—4 in FIG. 3, particularly illustrating a portion of the oscillating drive components for the stamp applicator drum.

In any case, applicator 2 is used with a machine 8 that includes means for feeding envelopes through the machine one by one. As shown in FIG. 1, postage metering machine 8 has an envelope guide channel 10. The envelope feeding means includes a plurality of rotatable rollers 12 or similar elements that are powered and essentially form a conveyor for feeding envelopes sequentially through guide channel 10 and out of machine 8. Postage metering machine 8 includes an electrical drive motor for powering the envelope feeding means. As shown in FIG. 4, a driven gear 14 is coupled to the drive motor or the envelope feeding means in some fashion and rotates through one complete turn or 360° revolution for each envelope that is fed through machine 8. Driven gear 14 serves as a rotary drive input for powering applicator 2.

Applicator 2 has a housing 16 on which the various parts of applicator 2 are carried. By way of introduction only, the major parts of applicator 2 carried on housing 16 comprise:

a) a rotary stamp applicator drum 18;

b) a coiled supply 20 of postage stamps or the like; and c) a drive means 22 for oscillating stamp applicator drum 18.

One important feature of this invention, to be described in greater detail below, is the advancement of at least one stamp and its affixation by stamp applicator drum 18 to the envelope passing beneath applicator 2 during one complete cycle of oscillation of stamp applicator drum 18.

Figure 3:
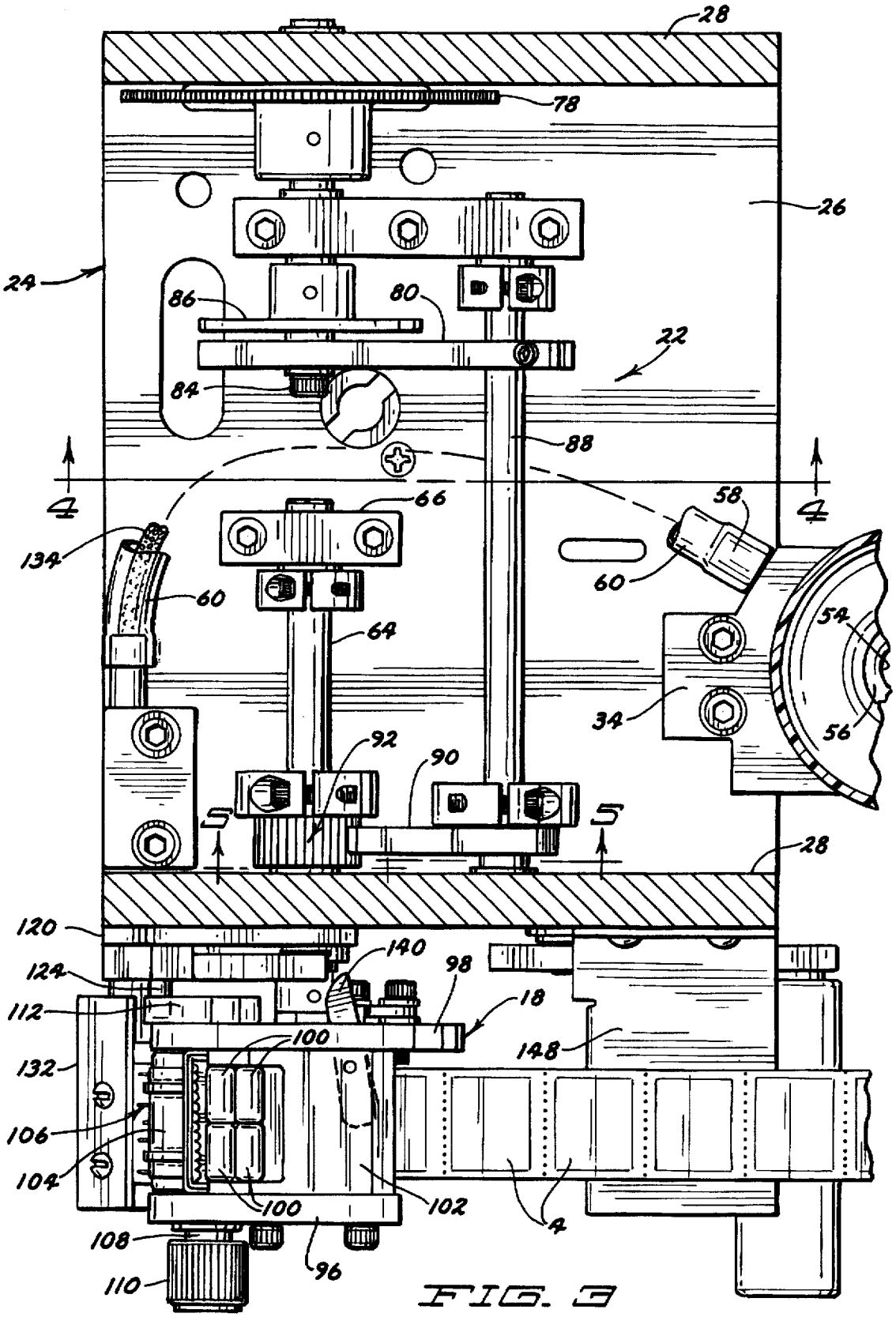
FIG. 3 is a cross-sectional view of the postage stamp applicator of this invention taken along lines 3—3 in FIG. 2, particularly illustrating the oscillating drive components for the stamp applicator drum as well as the top of the stamp applicator drum.

Housing 16 of applicator 2 comprises a U-shaped base 24 that is fixedly connected to postage metering machine 8 in any suitable fashion. Base 24 comprises a substantially horizontal bottom wall 26 with two spaced, vertically extending end walls 28 projecting upwardly therefrom. As seen in FIG. 3, drive means 22 for oscillating stamp applicator drum 18 is largely housed in the space or chamber formed between end walls 28. Stamp applicator drum 18 itself is carried next to and exteriorly of one of the end walls 28.

The remainder of housing 16 is formed by a U-shaped cover 30 that normally fits over base 24 to enclose the space between end walls 28 and to fit over and enclose stamp applicator drum 18. Cover 30 can include a handle 32 for lifting cover 30 on and off base 24, but cover 30 is normally secured to base 24 by a plurality of attachment screws (not shown). The view of FIG. 3 is taken with cover 30 removed from base 24. FIG. 1 shows cover 30 in place on base 24 with a portion of one of the exterior walls of cover 30 having been broken away to show stamp applicator drum 18.

Referring now to FIGS. 1 and 3, a bottle support member 34 is affixed to base 24 and extends through a slot (not shown) in one of the side walls of cover 30 for holding the neck of an inverted, liquid containing bottle 36. The upper portion of bottle 36 is constrained against tipping by an upper support bracket 38 on cover 30 that is located above bottle support member 34. Upper support bracket 38 has an opening (not shown) that encircles the upper portion of bottle 36. However, bottle 36 can be removed for replacement by lifting bottle 36 straight up out of bottle support member 34 and through and up out of upper support bracket 38.

Upper support bracket 38 also serves as the support for a mounting means 40 comprising a double walled case 42 in which the coiled supply 20 of postage stamps or similar items, e.g. adhesive labels, is rotatably carried between the walls of case 42 on a transverse shaft 44. The stamps come off coil 20 in a free end that is fed down and around a guide means 46 in a S-shaped manner. The guide means 46 comprises a guide roller 48 that is mounted on one end of a pivotal swing arm 50 in the manner of a pendulum to hang straight down from the stamp containing case 42. The free end of the stamps extend over the pivot point 52 for swing arm 50 and then down and back around guide roller 48 in the S-shaped manner as shown in FIG. 1. Guide means 46 ensures that stamps will be fed off coil 20 properly without breaking or tearing.

Both bottle 36 and coiled stamp supply 20 are carried on housing 16 exteriorly of cover 30 to allow ease of replacement. As noted earlier, when the supply of liquid in bottle 36 is at or close to exhaustion, the empty bottle can be lifted straight up out of bottle support member 34 and vertically up and out of upper support bracket 38 to allow a new bottle to be installed thereon. Each bottle of liquid preferably has a ball check valve (not shown) which will fall by gravity down into the neck of bottle 36 to seal the bottle mouth when bottle 36 is inverted to prevent leakage of liquid therefrom as a new bottle 36 is being installed. When a new bottle is installed with its neck received in bottle support member 34, an upstanding post 54 in bottle support member 34 will engage and raise the ball check valve upwardly a short distance to allow liquid to flow down from bottle 36 into a chamber 56 located in bottle support member 34. From there, the liquid is conducted through an outlet 58 and tubing 60 for use in moistening the stamps as will be described hereafter. The liquid contained in bottle 36 preferably comprises water.

Shaft 44 rotatably mounting stamp coil 20 is simply dropped down into a slot 62 carried in the top edge of the spaced walls of case 42. Different slots 62 can be spaced along the top edge of case 42 to accommodate different sized stamp coils 20 having different outer diameters. Thus, when a particular stamp coil 20 is exhausted, it is a simple matter to simply lift shaft 44 up out of slot 62, to insert shaft 44 through a new stamp coil 20, and to then drop shaft 44 back down into slot 62 with stamp coil 20 being received between the side walls of case 42. The free end of the stamps may then be pulled off stamp coil 20 and threaded in the previously described S-shaped manner down around guide means 46. From there, the free end of stamps extends over and is attached to stamp applicator drum 18.

Figure 6:
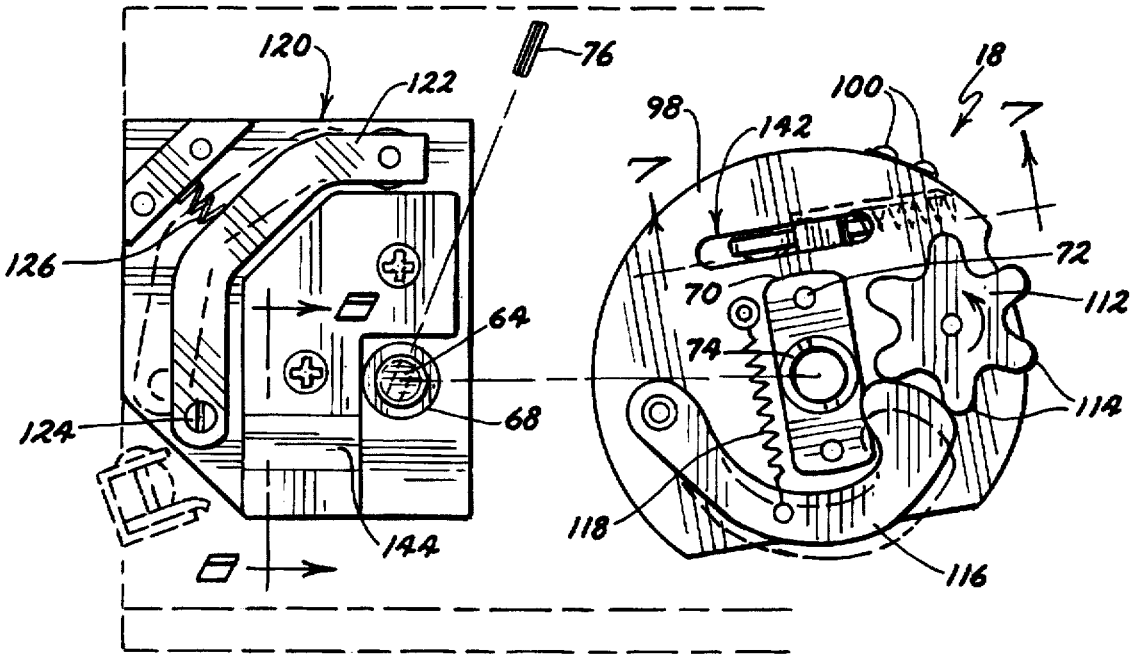
FIG. 6 is an exploded assembly view of the stamp applicator drum, with the drum having been removed from its rotary shaft and turned around to illustrate the back of the drum and the components thereon and to illustrate a fixed bracket carried on the housing of the applicator which bracket has various elements that interact with the components carried on the back of the drum.
Figure 8:
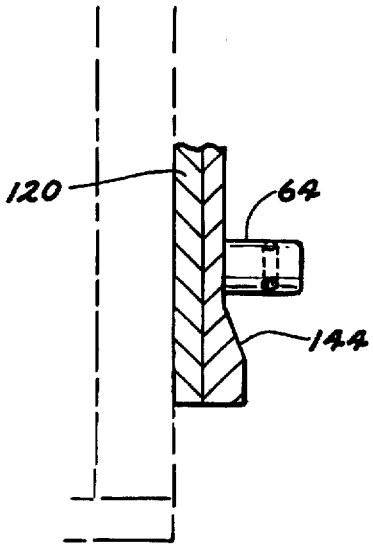
FIG. 8 is a cross-sectional view through the fixed bracket taken along lines 8—8 of FIG. 6, particularly illustrating the cam for operating the reciprocal knife blade shown in FIG. 7 and the end of the rotary shaft that carries the drum.

Referring now to FIGS. 3 and 6, stamp applicator drum 18 is rotatably mounted on a drive shaft 64 that rotates about a horizontal axis in housing 16. A first or inner portion of drive shaft 64 is rotatably carried in a bearing block 66 affixed to bottom wall 26 of base 24 with a middle portion of drive shaft 64 being further rotatably supported in another bearing 68 carried in one end wall 28. Drive shaft 64 extends outwardly past this end wall 28 to be attached to stamp applicator drum 18. Referring to FIG. 6, the back of stamp applicator drum 18 includes an attachment bracket 70 that is fixed thereto by pins or rivets 72 and includes a central hub 74 into which the outer end of drive shaft 64 extends. An attachment pin 76 extends through aligned openings in hub 74 and drive shaft 64 to non-rotatably affix stamp applicator drum 18 to drive shaft 64.

Figure 5:
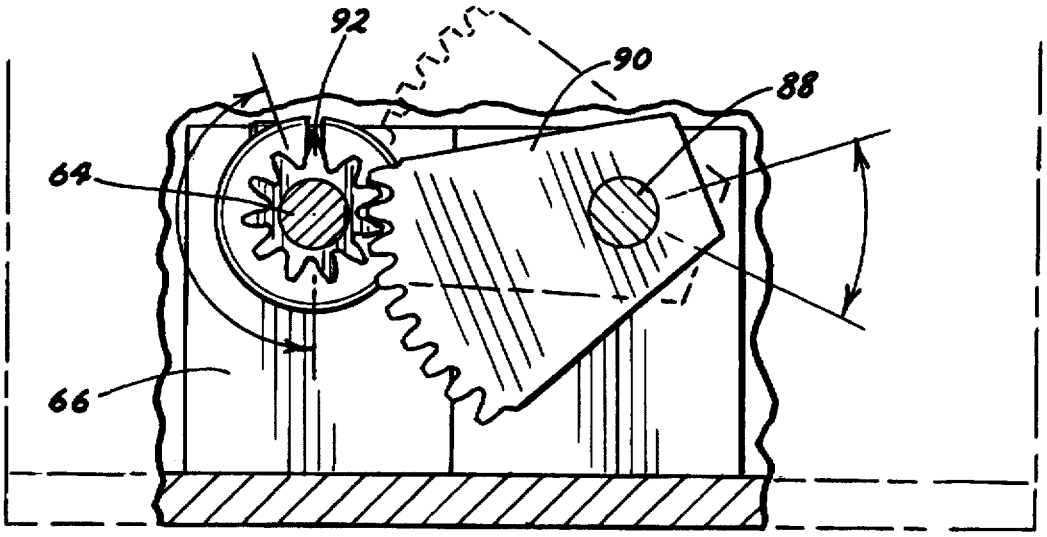
FIG. 5 is a cross-sectional view taken along lines 5—5 in FIG. 3, particularly illustrating another portion of the oscillating drive components for the stamp applicator drum.

Referring now to FIGS. 3–5, drive means 22 for oscillating stamp applicator drum 18 is preferably a mechanical transmission that converts the 360° rotary movement of driven member 14 on machine 8 into an oscillating movement of drive shaft 64 on which stamp applicator drum 18 is mounted. This transmission includes a first gear 78 rotatably carried inside base 24 and being engaged with driven gear 14. In addition; the transmission includes a crank arm 80 having a slot 82 therein for receiving a pin 84 carried a rotary disc 86 that rotates in concert with the gear member. As first gear 78 and disc 86 rotate about their common rotational axis, their rotary motion is converted to an oscillating motion of crank arm 80.

In turn, crank arm 80 is connected to a horizontal crankshaft 88 supported in base 24 and being spaced from but parallel to the axis of drive shaft 64. Crankshaft 88 includes a spur gear 90 that engages with a relatively small gear 92 on drive shaft 64 to which stamp applicator drum 18 is affixed. Thus, for each complete revolution of driven gear 14, an oscillating motion is created in crank arm 80 which oscillating motion is used to oscillate stamp applicator drum 18 through the action of crank arm 80, crankshaft 88, spur gear 90 and small gear 92. The oscillating action created by drive means 22 is shown in phantom lines in FIGS. 4 and 5.

The mechanical transmission shown in FIGS. 3–5 is preferably used for oscillating stamp applicator drum 18 for a number of reasons. The rotary input represented by driven gear 14 is already present in postage metering machines and is already timed to the movement of an envelope through machine 8. Thus, stamp applicator drum 18 can be oscillated using an already existing drive mechanism without requiring a separate motor or the like. In addition, assuming the parts are properly aligned and assembled relative to one another, the motion of stamp applicator drum 18 will be automatically coordinated with the movement of the envelope through machine 8, i.e. stamp applicator drum 18 will stop and start its oscillation at the proper time to apply at least one stamp to the envelope passing through machine 8. Thus, no special timing mechanism is required for stamp applicator drum 18.

However, drive means 22 envisioned by this invention is not limited to that shown in this application. For example, a separate electrical drive motor could be provided to oscillate stamp applicator drum 18, with such motor being started, reversed, and then stopped to oscillate stamp applicator drum 18 in a complete cycle of oscillation in a timed manner to the passage of an envelope. If such a separate electrical motor is used as drive means 22, a timing and control means will be required for sensing the operation of machine 8 or an envelope passing therethrough so as to properly start, reverse and stop the motor to achieve the required oscillation of stamp applicator drum 18 at just the right time.

As noted immediately above, drive means 22 oscillates stamp applicator drum 18 in one complete cycle of oscillation for each piece envelope as each envelope is directed through machine 8. The oscillation of stamp applicator drum 18 is properly timed to the envelope passage. In addition, for each cycle of oscillation, stamp applicator drum 18. performs the following functions:

a) advances a predetermined number of stamps from the periphery of stamp applicator drum 18 while pulling additional stamps off stamp coil 20;

b) passes the stamps so advanced past a moistening device which is positioned to moisten the back or gummed side of the stamps;

c) severs the stamps so advanced and moistened; and d) affixes the severed stamps to the envelope by pressing down on the front or non-gummed side of the stamp to engage the moistened back side of the stamp with the face of the envelope.

In some aspects, the structure and function of stamp applicator drum 18 is similar to that of a stamp applicator drum illustrated in U.S. Pat. No. 3,802,941 to Whiteford et al., which patent is hereby incorporated by reference for a further showing of some of the details of such a drum.

Figure 2:
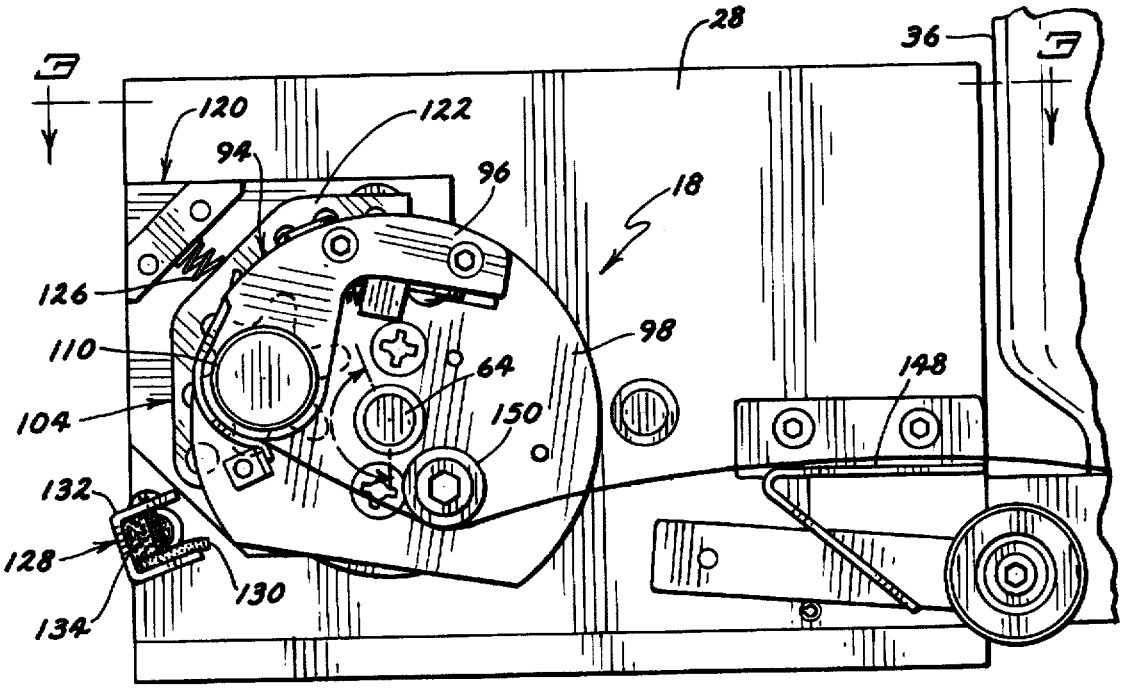
FIG. 2 is an enlarged side elevational view of a portion of the postage stamp applicator shown in FIG. 1, particularly illustrating the applicator with its cover removed to thereby expose and illustrate the front of the stamp applicator drum.

Stamp applicator drum 18 is non-rotatably fixed to drive shaft 64 for rotation about the axis of drive shaft 64. Stamp applicator drum 18 includes an arcuate, partial circumferential outer surface 94 extending between front and rear walls 96 and 98 of stamp applicator drum 18. Rear wall 98 of stamp applicator drum 18 is fairly large and carries attachment bracket 70 which attaches to drive shaft 64 as shown in FIG. 6. Front wall 96 of stamp applicator drum 18 is a small L-shaped wall that is spaced from rear wall 98 by a suitable distance to define a gap therebetween, but which is basically much smaller than rear wall 98, as seen most clearly in FIG. 2. The arcuate, partial circumferential outer surface 94 is defined, in part, by the aligned arcuate edges of the front and rear walls 96 and 98 of stamp applicator drum 18 where such edges exist.

The circumferential outer surface 94 includes a pair of dual spaced rollers 100, four in all, which project slightly upwardly from the circumferential surface 94. See FIGS. 2 and 6. Rollers 100 are freely rotatably mounted in the spaced and opposed arms of a U-shaped yoke 102 that is fixed between the front and rear walls of stamp applicator drum 18. Rollers 100 are free to rotate in the manner of roller bearings. Their purpose, which will be described more fully below, is to press down on the stamp as the stamp is being affixed to the envelope to help decurl the stamp and insure that the stamp is properly applied to the envelope, i.e. lies flat against the envelope.

Stamp applicator drum 18 carries a rotatable stamp metering head 104 in a position circumferentially offset from decurling rollers 100. Stamp metering head 104 includes a plurality of rows 106 of radially extending pins or sprockets which are spaced around the circumference of stamp metering head 104. The spacing between the rows 106 of pins or sprockets is equal to the spacing between the perforations in the stamp ribbon such that the pins or sprockets will register with the perforations to feed the stamp ribbon through stamp applicator drum 18.

Stamp metering head 104 is rotatably carried on a shaft 108 that is journalled between the front and rear walls 96 and 98 of stamp applicator drum 18. One end of shaft 108 extends outwardly in front of front wall 96 of stamp applicator drum 18 and carries a knob 110 thereon to allow shaft 108 to be manually manipulated. The rear end of shaft 108 extends rearwardly to a location in back of the rear wall 98 of stamp applicator drum 18. The rear end of shaft 108 carries an integrally formed star wheel 112 having a plurality of outwardly extending prongs 114. See FIG. 6. Shaft 108 and star wheel 112 are integrally formed and case hardened for durability.

A rotatably mounted retaining finger 116 is biased, by means of a spring 118, into engagement with star wheel 112 and operates as a brake to prevent inadvertent rotation of star wheel 112. Retaining finger 116 and spring 118 are mounted on the rear wall 98 of stamp applicator drum 18 such that the end of finger 116 bears against a portion of the circumference of star wheel 112, i.e. against a couple of prongs 114. However, as will be described shortly, star wheel 112 is intentionally rotated at times during the oscillation of stamp applicator drum 18 to feed or meter a predetermined number of stamps, usually one stamp, therefrom. During such intentional rotation, prongs 114 of star wheel 112 will act on and cam retaining finger 116 down away from the circumference of star wheel 112 as shown in phantom lines in FIG. 6. Once intentional rotation of star wheel 112 ends, the bias of spring 118 is sufficient to cause finger 116 to resume its normal solid line position of FIG. 6 in which it exerts a frictional restraining force on star wheel 112 to prevent inadvertent rotation thereof.

One end wall 28 of base 24 carries a fixed bracket 120 on which is mounted a pivotal arm 122 having a peg 124 carried at a lower end opposite to the pivot point for arm 122. A biasing spring 126 extends between a fixed wall on bracket 120 and arm 122 for placing arm 122 into a first normal position as shown in solid lines in FIG. 6. It is the engagement of peg 124 with prongs 114 of star wheel 112 that cause star wheel 112 to intentionally rotate about its rotational axis 108, thereby rotating stamp metering head 104. Peg 124 is brought into engagement with star wheel 112 by virtue of the oscillation of stamp applicator drum 18 as will be described in more detail hereafter.

A moistening device 128 is provided for applying moisture to the gummed or back side of a stamp that has been advanced or fed out of stamp applicator drum 18 by stamp metering head 104. This moistening device 128 comprises a moisture absorptive flat pad 130 which is fixedly carried in a U-shaped trough 132 on one end wall 28 extending towards and into close proximity with the periphery of stamp applicator drum 18. Flat pad 130 is kept supplied with water by an elongated cylindrical wick 134 that extends back from U-shaped trough 132 into the interior of base 24 to be received in one end of tubing 60. The other end of tubing 60 is operatively connected to water outlet 58 on bottle support member 34 for connecting to water supply chamber 56 in bottle support member 34. Thus, the water in bottle 36 flows down into bottle support member 34 and through tubing 60 to cylindrical wick 134. Cylindrical wick 134 then causes the water to travel into U-shaped trough 132 to keep flat pad 130 constantly moistened.

Figure 7:
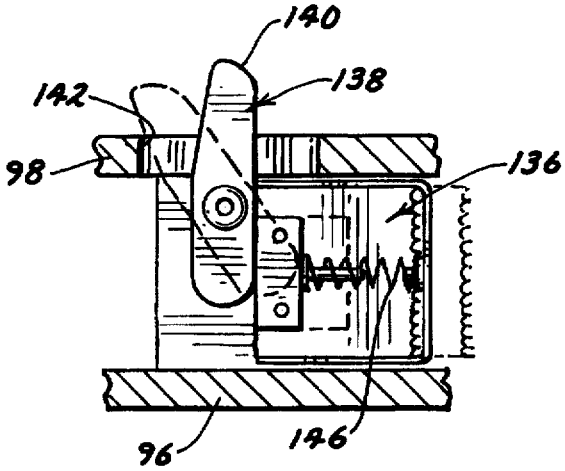
FIG. 7 is a cross-sectional view through the stamp applicator drum taken along lines 7—7 of FIG. 6, particularly illustrating the reciprocal knife blade carried in the drum for severing a predetermined number of stamps.

Stamp applicator drum 18 further includes a means for severing a predetermined number of stamps after such stamps have been fed out or advanced by stamp metering head 104. This severing means comprises a knife blade 136 that is slidably carried in stamp applicator drum 18 with the knife edge of blade 136 being normally located in the interior of stamp applicator drum 18 as shown in solid lines in FIG. 7. A cam lever 138 is pivotally carried on stamp applicator drum 18 and has an outer end 140 that extends through a slot 142 placed in the rear wall 98 of stamp applicator drum 18. Outer end 140 of cam lever 138 will engage a fixed cam surface 144 carried on fixed bracket 120 during a portion of the oscillation of stamp applicator drum 18. This engagement will pivot cam lever 138 from its solid to its dotted line position shown in FIG. 7, thus causing knife blade 136 to be slid or extended out of stamp applicator drum 18 a short distance until the knife edge thereof is positioned radially outwardly of stamp applicator drum 18. This extension of knife blade 136, shown in phantom lines in FIG. 7, will be sufficient to sever a predetermined number of stamps along one of the perforation lines between adjacent stamps. Once cam lever 138 no longer engages the cam surface, a biasing spring 146 will retract knife blade 136 and cause knife blade 136 and cam lever 138 to return to their normal solid line positions.

The stamp ribbon passing from supply 20 thereof passes across the top of a substantially horizontal guide surface 148 that is fixed to one end wall 28 of base 24. The ribbon does not pass directly in a straight line to stamp metering head 104 of stamp applicator drum 18, but instead passes beneath a fixed post 150 or the like carried on stamp applicator drum 18 somewhat beneath drive shaft 64 of stamp applicator drum 18 in the initial position of stamp applicator drum 18 shown in FIG. 2. Thus, the stamp ribbon first slopes down to pass beneath post 150 and then slopes up to extend up to stamp metering head 104 with one of the rows of pins or spikes thereon engaged with one of the rows of perforations. Applicants have found that the use of this post 150 and the initial stamp orientation shown in FIG. 2 properly feeds stamps from supply 20 thereof without breaking the stamps.

Figure 9:
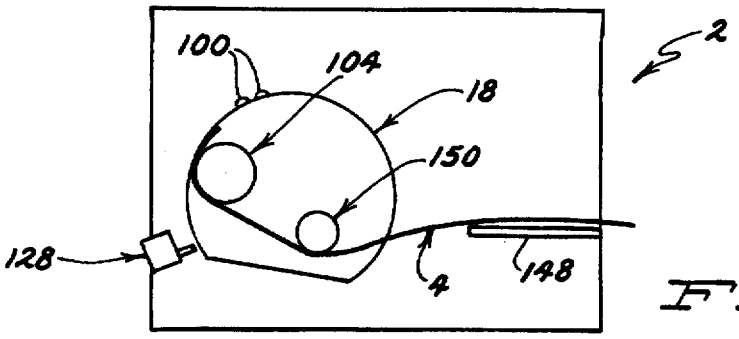
FIGS. 9–12 depict a first portion of one cycle of oscillation of the stamp applicator illustrating the advancement of a predetermined number of stamps from the drum, the moistening of such stamps, and the severing and affixation of the stamps to an envelope.

The operation of postage stamp applicator 2 will now be described with reference to FIGS. 9–12. FIG. 9 illustrates the position of stamp applicator drum 18 and the stamp ribbon at the beginning of each cycle of oscillation thereof. The solid line position of the drive components shown in FIGS. 4 and 5 correspond to this position of stamp applicator drum 18. In other words, when crank arm 80 is in the position shown in FIG. 4, stamp applicator drum 18 is in the position shown in FIG. 9, all positioned to be at the beginning or initial position of a cycle of oscillation. When a new envelope is fed through machine 8 and the rotational input from driven gear 14 is received, a cycle of oscillation of stamp applicator drum 18 will begin, with the oscillation being provided by the operation of drive means 22.

Figure 10:
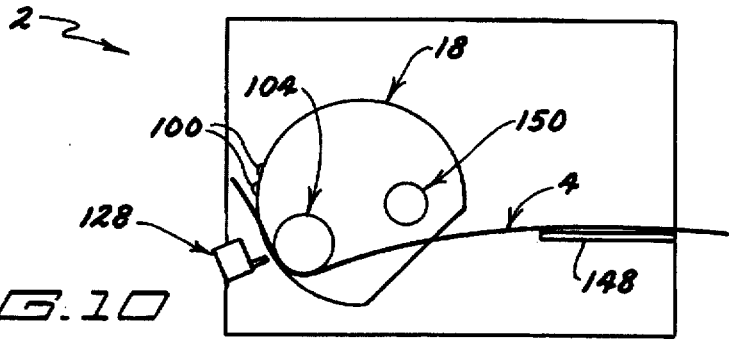

As the oscillation begins, stamp applicator drum 18 will begin to rotate down or in a counter-clockwise direction by virtue of the counter-clockwise rotation of drive shaft 64. As stamp applicator drum 18 so rotates, star wheel 112 follows in a concentric path about the axis of rotation until peg 124 on arm 122 engages and fits into the groove between adjacent prongs 114 of star wheel 112. When moving downwardly relative to peg 124, peg 124 acts as a fixed peg since little or no movement of arm 122 is allowed before arm 122 engages against the side of the structure defining the blade actuating cam 144. Thus, peg 124 serves to rotate star wheel 112 from one prong to the next during this counter-clockwise rotation of stamp applicator drum 18 until star wheel 112 has rotated through an arc covered by two prongs 114, corresponding to the length of one stamp. This rotation of star wheel 112, which is rotatably fixed to stamp metering head 104, causes a similar rotation of stamp metering head 104 to cause one stamp to be advanced from the head and to be fed out of stamp applicator drum 18. This stamp advancement is shown in FIG. 10.

Figure 11:
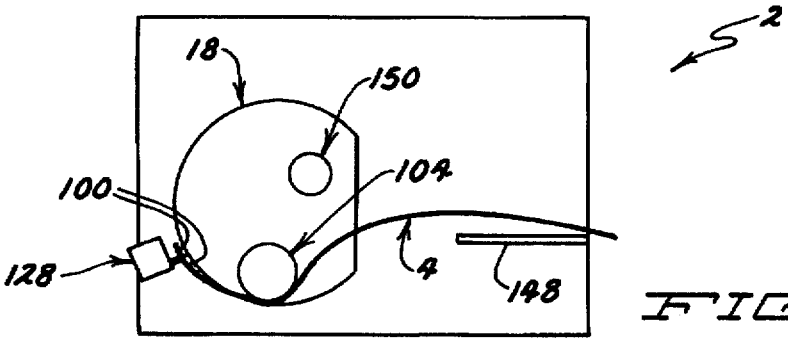

After the stamp is so advanced, it will overlie or be proximate to that portion of stamp applicator drum 18 carrying the sets of decurling rollers 100. As stamp applicator drum 18 continues its rotation, it will pass in close proximity to the moistening device 128. The decurling rollers 100, which protrude slightly from stamp applicator drum 18, will help press the back or gummed side of the stamp against the flat moistening pad 130 as shown in FIG. 11. Thus, in this portion of the counter-clockwise rotation, the stamp is automatically licked or moistened as demonstrated in FIG. 11.

Figure 12:
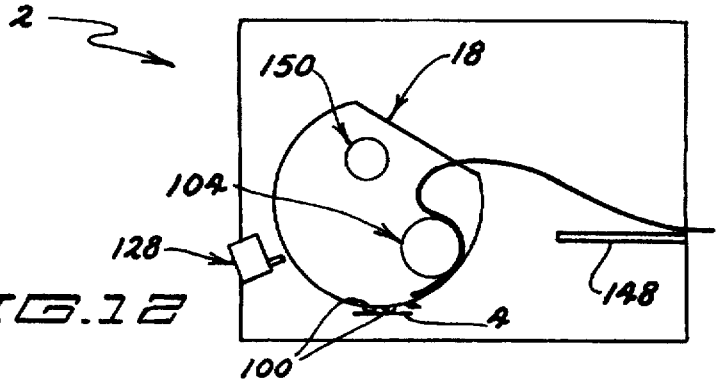

Finally, as stamp applicator drum 18 nears the end of the counter-clockwise rotation portion of its oscillation, the stamp is then severed and pressed against the envelope. The severing occurs when knife blade 136 is projected radially outwardly of the outer surface of stamp applicator drum 18 along the line of perforations between adjacent stamps. This knife blade projection is shown in FIG. 12. At or about the same time, the decurling rollers 100, which are still positioned to overlie the front side of the stamp, will then be located to press vertically downwardly on the stamp to affix it to the envelope, which envelope is then located immediately below stamp applicator drum 18 during its travel through postage metering machine 8. In fact, the operation of stamp applicator drum 18 is timed to the envelope passage by suitable arrangement of the components so that the stamp is affixed to the envelope in the normal position for postage, i.e. at the upper right corner of the front of the envelope. Thus, stamp applicator drum 18 in approximately one half of its cycle of oscillation, i.e. in the counter-clockwise cycle, advances a stamp, moistens the stamp, severs the stamp and presses or affixes the stamp to an envelope.

After a first stamp is affixed to the envelope, drive means 22 will then be at the position where stamp applicator drum 18 reverses its rotational direction to complete the cycle of oscillation. During this reverse, or clockwise rotation of stamp applicator drum 18, the fixed post 150 carried on stamp applicator drum 18, which has become spaced from the stamp ribbon as shown in FIG. 12, will move downwardly and will reengage the stamp ribbon between the metering drum and guide surface 148. As post 150 continues to move back to its initial position shown in FIG. 9, it will press down on the stamp ribbon to put a bend into the ribbon and remove some of the tension that would otherwise exist in the ribbon. Such movement of the ribbon is effectively allowed by the swingable guide roller 48 which will swing slightly to accommodate the ribbon motion caused by the action of post 150. The combination of post 150 and swingable guide roller 48 thus cause the stamp ribbon to follow a somewhat convoluted path on its way to stamp applicator drum 18, to allow the stamps to be properly fed by stamp applicator drum 18 without having undue tension in the stamp ribbon that would otherwise interfere with the feeding or cause the stamp ribbon to break.

As stamp applicator drum 18 completes its clockwise rotation to reset itself to its initial position of FIG. 9, star wheel 112 will at some point again engage against peg 124 on the pivotal arm 122. However, when drum 18 moves in this direction, peg 124 does not act as a fixed peg. Instead, there is nothing abutting or constraining arm 122 from pivoting up and away from star wheel 112. Thus, star wheel 112 will hit peg 124, but instead of having peg 124 reversely rotate star wheel 112, star wheel 112 will simply act on and cam peg 124 and its support arm 122 up and out of the way of star wheel 112. This is illustrated in FIG. 6 in the phantom line illustrations of the arm and peg 124. Once star wheel 112 clears peg 124, biasing spring 126 will reset the arm and peg 124 to their normal solid line positions shown in FIG. 6.

Applicator 2 of this invention has numerous advantages as compared to prior art devices. It uses a simple oscillating stamp applicator drum 18 rather than a drum using a vacuum or other pressure means for handling the stamp. The stamps can come off the stamp supply 20 and extend to this type of drum in a straight line without having to be twisted or bent in any fashion. Stamp applicator drum 18 includes decurling means (the rollers 100) for pressing against the top or front side of a stamp, both to help moisten the stamp and to help affix it firmly to the envelope. Stamp applicator drum 18 and stamp supply 20 include cooperating posts 150 and swingable guide roller 48 that pull additional stamps in a ribbon off of supply 20 and passes such ribbon to stamp applicator drum 18 without breaking or severing the ribbon or creating undue tension therein.

Various modifications of this invention will be apparent to those skilled in the art. For example, while the stamp applicator drum has been described as metering or feeding out a single stamp, the parts could be configured to cause more than a single stamp to be fed out, e.g. two or three stamps instead of one. Thus, this invention relates to an applicator drum that feeds out a predetermined number of stamps without being limited to what that number is. In addition, the term stamp is not intended to limit the invention. The stamp applicator drum would also be useful for feeding out perforated labels or the like as well. Thus, the scope of the invention is to be limited only by the appended claims.

We claim:

1. A postage stamp applicator for a mailing machine having means for automatically advancing individual envelopes along a predetermined path and a driven member which rotates one turn each time an envelope passes through the machine, the applicator comprising:

(a) a housing with a drive shaft rotatably mounted therein, the housing having means for engaging the housing to the mailing machine during use of the postage stamp applicator;

(b) a stamp applicator drum affixed to the drive shaft for rotation therewith and further positioned so that an outer surface of the stamp applicator drum is brought into engagement with envelopes advancing along the path;

(c) means for mounting a perforated coil of stamps on the housing for rotation about an axis with the free end of the coil passing through the housing to the stamp applicator drum;

(d) drive means for producing for each turn of the driven member an oscillating rotary movement of the drive shaft to thereby cause the stamp applicator drum to oscillate in a first rotary direction and then back in a second rotary direction opposed to the first direction in a complete cycle of oscillation for each turn of the driven member;

(e) metering means carried on the stamp applicator drum receiving the free end of the coil of the stamps in engagement therewith for moving a predetermined number of stamps outwardly of the stamp applicator drum during each cycle of oscillation; and (f) means associated with the stamp applicator drum for severing the stamps advanced from the stamp applicator drum during each cycle of oscillation to allow the advanced and severed stamps to be applied to the outwardly directed surface of the advancing envelopes.

2. A postage stamp applicator as recited in claim 1, further including a transmission means operatively connecting the driven member to the drive shaft, wherein the transmission means is configured to mechanically convert each turn of the driven member into an oscillating motion of the drive shaft.

3. A postage stamp applicator as recited in claim 2, wherein the transmission means includes a crank arm operatively connected to the driven member which crank arm drives a crankshaft operatively connected to the drive shaft.

4. A postage stamp applicator as recited in claim 1, wherein the stamp applicator drum further includes means carried on the outer surface thereof for decurling the predetermined number of stamps advanced by the stamp applicator drum by pressing downwardly onto the predetermined number of stamps as such stamps are received on the outwardly directed surface of the advancing envelopes.

5. A postage stamp applicator as recited in claim 4, wherein the decurling means comprises at least one roller member which is freely rotatably carried on the stamp applicator drum.

6. A postage stamp applicator as recited in claim 5, wherein the decurling roller has an outer surface that projects slightly radially outwardly from the outer surface of the stamp applicator drum.

7. A postage stamp applicator as recited in claim 5, wherein the decurling means comprises a plurality of roller members which are freely rotatable on the stamp applicator drum.

8. A postage stamp applicator as recited in claim 1, further including means located adjacent the outer surface of the stamp applicator drum during oscillating motion of the stamp applicator drum for moistening a back side of the advanced stamps.

9. A postage stamp applicator as recited in claim 8, further including at least one roller freely rotatably carried on the stamp applicator drum and projecting radially outwardly from the outer surface of the stamp applicator drum, the roller being circumferentially spaced on the stamp applicator drum from the metering means to allow the predetermined number of stamps advanced from the stamp applicator drum by the metering means to generally overlie the rollers.

10. A postage stamp applicator as recited in claim 9, wherein the moistening means is located relative to the stamp applicator drum and the roller such that the roller presses the back side of the predetermined number of stamps into engagement with the moistening means to moisten the back side of the predetermined number of stamps.

11. A postage stamp applicator as recited in claim 1, wherein the coil mounting means includes a roller extending vertically from the mounting means and pivotally mounted on the mounting means at an upper pivot point so as to be swingable on the mounting means about the pivot point, the free end of the stamp coil extending around the pivot point and the swingable roller in an S-shaped manner as the free end passes towards the stamp applicator drum.

12. A postage stamp applicator as recited in claim 11, further including a post carried on the stamp applicator drum with the post having a lower surface spaced below a lower surface of the metering means and a lower surface of the swingable roller in an initial position of the stamp applicator drum at the beginning of each cycle of oscillation of the stamp applicator drum, wherein the post causes the free end of the stamps to bend downwardly as the free end of the stamps passes from the swingable roller towards the metering head in the initial position of the stamp applicator drum.

13. A postage stamp applicator as recited in claim 1, wherein the metering head is non-rotatably affixed to a star wheel having a plurality of outwardly projecting prongs, and further including a peg carried on the housing in a path to intercept the star wheel during oscillation of the stamp applicator drum, the peg being fixed in place during movement of the stamp applicator drum in one direction during the cycle of oscillation to rotate the star wheel and thereby advance the predetermined number of stamps, the peg being free to move during movement of the stamp applicator drum in the opposed second direction of the cycle of oscillation to allow the peg to be moved out of the way by the star wheel without reversely rotating the star wheel as the stamp applicator drum moves back to an initial position thereof at the beginning of the cycle of oscillation.

14. In a postage stamp applicator including a housing, a stamp applicator drum rotatably mounted on the housing, metering means on the stamp applicator drum operative upon rotation of the stamp applicator drum to meter a predetermind number of stamps from the stamp applicator drum, the improvement comprising drive means for oscillating the stamp applicator drum back and forth on the housing in forward and reverse rotary directions during operation of the metering means.

15. A postage stamp applicator as recited in claim 14, wherein the metering means including means operative in the forward direction of the oscillating motion for rotating the metering means on the stamp applicator drum to cause a predetermined number of stamps to be advanced outwardly by the metering means, the means for rotating the metering means being ineffective for rotating the metering means during the reverse direction of the oscillating motion of the stamp applicator drum to allow the stamp applicator drum to be reset to an initial position without causing reverse rotation of the metering means.

16. In a postage stamp applicator including a housing, a stamp applicator drum rotatably mounted on the housing, metering means on the stamp applicator drum operative upon rotation of the stamp applicator drum to meter a predetermined number of stamps from the stamp applicator drum, and a coiled supply of such stamps carried on the housing having a free end for extending to the stamp applicator drum, the improvement comprising a swingable guide roller carried on the housing and pivoted therein at an upper pivot point, the free end of the stamps extending from the coiled supply to the metering means after passing over the pivot point and then down and around the guide roller in an s-shaped manner to allow the swingable guide roller to help direct the free end of the stamps from the coiled supply thereof to the metering means.

17. A postage stamp applicator as recited in claim 16, further including a post carried on the stamp applicator drum with the post having a lower surface spaced below a lower surface of the metering means and a lower surface of the swingable roller in an initial position of the stamp applicator drum at the beginning of each cycle of oscillation of the stamp applicator drum, wherein the post causes the free end of the stamps to bend downwardly as the free end of the stamps passes from the swingable roller towards the metering head in the initial position of the stamp applicator drum.

18. A postage stamp applicator as recited in claim 16, further including means for arranging the coiled stamp supply such that the free end of the stamps extends to the metering means without twisting.

* * * * *